United States Patent [19]

Spars et al.

[11] Patent Number: 4,579,644

[45] Date of Patent: Apr. 1, 1986

[54] TEMPERATURE GRADIENT IN RETORT FOR PYROLYSIS OF CARBON CONTAINING SOLIDS

[75] Inventors: Byron G. Spars, Mill Valley; Robert P. Sieg, Walnut Creek, both of Calif.

[73] Assignee: Chevron Research Company, San Francisco, Calif.

[21] Appl. No.: 271,298

[22] Filed: Jun. 8, 1981

[51] Int. Cl.[4] ..... C10G 1/00; C10B 53/06

[52] U.S. Cl. ..... 208/11 R; 208/8 R

[58] Field of Search ..... 208/11 R, 8 R

[56] References Cited

U.S. PATENT DOCUMENTS

| | | | |
|---|---|---|---|
| 2,448,223 | 8/1948 | Lantz | 208/11 R X |
| 2,626,234 | 1/1953 | Barr et al. | 208/11 R X |
| 3,167,494 | 1/1965 | Crawford | 208/8 R |
| 3,960,702 | 6/1976 | Allred | 208/11 |
| 4,116,810 | 9/1978 | Jones, Jr. et al. | 208/11 |
| 4,183,800 | 1/1980 | Mitchell et al. | 208/8 |
| 4,199,432 | 4/1980 | Tamm et al. | 208/11 R X |
| 4,293,401 | 10/1981 | Sieg et al. | 208/11 R |

FOREIGN PATENT DOCUMENTS

| | | | |
|---|---|---|---|
| 677140 | 8/1952 | United Kingdom | 208/11 R |

*Primary Examiner*—John Doll
*Assistant Examiner*—Glenn A. Caldarola
*Attorney, Agent, or Firm*—J. A. Buchanan, Jr.; S. R. LaPaglia; Q. T. Dickinson

[57] ABSTRACT

A temperature gradient in staged turbulent bed retort established by adding heat transfer material at different levels along vertical length of retort to prevent thermal cracking of product vapors.

4 Claims, 2 Drawing Figures

TEMPERATURE GRADIENT IN RETORT FOR PYROLYSIS OF CARBON CONTAINING SOLIDS

BACKGROUND OF THE INVENTION

Certain naturally-occurring materials such as oil shale, coal, tar sands, and diatomaceous earth contain a carbonaceous fraction. During retorting, these carbon-containing solids release an oil useful in petroleum processing. Oil shale is a shale-like rock containing an organic component, usually referred to as kerogen, which upon heating releases volatile hydrocarbons that may be recovered as shale oil. A residual carbonaceous material typically remains with the inorganic component left following pyrolysis.

The pyrolysis or retorting process may be carried out in a retorting vessel of various designs. In one method the raw oil shale is crushed into particulate material containing a particle size distribution not exceeding about 2-½ mesh (Tyler Standard Sieve) which is fed into the upper portion of the retorting vessel. The raw oil shale is mixed with hot solid heat carrier particles which, along with the raw shale, moves downward as a continuous bed of material through the retorting vessel. An upward flow of a non-oxidizing stripping gas counter-current to the downward moving shale carries the volatile hydrocarbons away from the bed. See U.S. Pat. No. 4,199,432. In order to prevent gross vertical backmixing and slugging of solids passing downward with the bed, the retorting vessel is equipped with a plurality of dispersing elements in the form of perforated plates, bars, screens, packing, or other suitable internals. The dispersing elements also serve to limit the size of gas bubbles passing up the retorting vessel.

In operating the retorting vessel it is important to remove the vapor products without thermal cracking if high liquid yields are to be obtained. One way of minimizing thermal cracking is to operate the retorting vessel at a relatively low temperature. However, lower temperatures require longer retorting times, which means increased residence time in the retort. A longer residence time requires a larger retort or a decrease in the amount of raw shale that can be processed. The present invention is directed to a method for efficiently pyrolyizing the raw shale with a minimum of thermal cracking.

BRIEF SUMMARY OF THE INVENTION

In its broadest aspect, the invention concerns a process for retorting a particulate carbon-containing solid wherein said carbon-containing solid is passed into the upper portion of a vertically-elongated retorting vessel equipped with a plurality of dispersing elements so constructed and arranged as to substantially limit backmixing and slugging of solids passing downward therethrough, heating the carbon-containing solids to retorting temperature principally by means of hot solid heat carrier particles to drive off volatile hydrocarbons, passing a non-oxidizing stripping gas upward through the retorting vessel, removing volatile hydrocarbons and stripping gas from the upper portion of the retorting vessel, and withdrawing the resulting retorted solids from the lower portion of the retort, the improvement comprising establishing an ascending temperature profile in the retorting vessel by introducing the hot solid heat carrier particles into the retorting vessel at two or more different levels along the vertical length of the retorting vessel, whereby a temperature gradient is created along the vertical axis of the retorting vessel-the highest temperature being at the bottom of the vessel with the temperature declining near the top.

More specifically, the invention concerns a process for retorting oil shale wherein particulate raw oil shale is retorted by passing said raw oil shale into the upper portion of a vertically-elongated retorting vessel equipped with a plurality of dispersing elements so constructed and arranged as to substantially limit backmixing and slugging of solids passing downward therethrough, heating the raw oil shale to retorting temperature principally by means of hot solid heat carrier particles to drive off volatile hydrocarbons, passing a non-oxidizing stripping gas upward through the retorting vessel, removing the volatile hydrocarbons and stripping gas from the upper portion of the retorting vessel, and withdrawing the resulting retorted oil shale from the lower portion of the retort, the improvement comprising establishing an ascending temperature profile in the retorting vessel by introducing the hot solid heat carrier particles into the retorting vessel at two or more different levels along the vertical length of the retorting vessel, whereby a temperature gradient is created along the vertical axis of the retorting vessel-the highest temperature being at the bottom of the vessel with the temperature declining near the top.

In a process of the type described above, the particles of raw oil shale and hot solid heat carrier particles normally do not exceed a maximum size of about 0.8 cm (2-½ mesh-Tyler Standard Sieve). Generally, the velocity of the flow of stripping gas in the retorting vessel falls within the range of from about 1 foot per second to about 5 feet per second. The hot solid heat carrier particles may be a ceramic composition, sand, alumina, burned shale (oil shale from which both the volatile hydrocarbons and residual carbonaceous material are removed), or the like. Most preferably, the heat carrier particles are burned oil shale used alone or mixed with a supplemental heat carrier material.

DETAILED DESCRIPTION OF THE INVENTION

Figure 1:
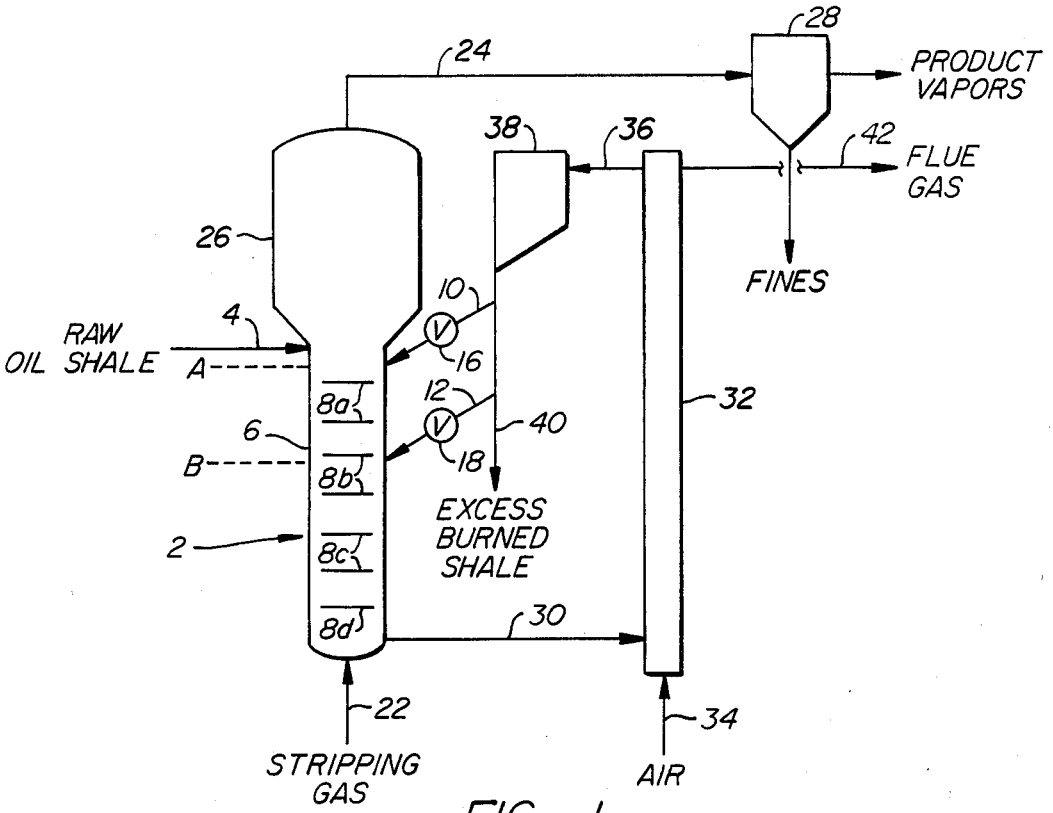
FIG. 1 is a schematic representation of a retorting process within the scope of the invention.
Figure 2:
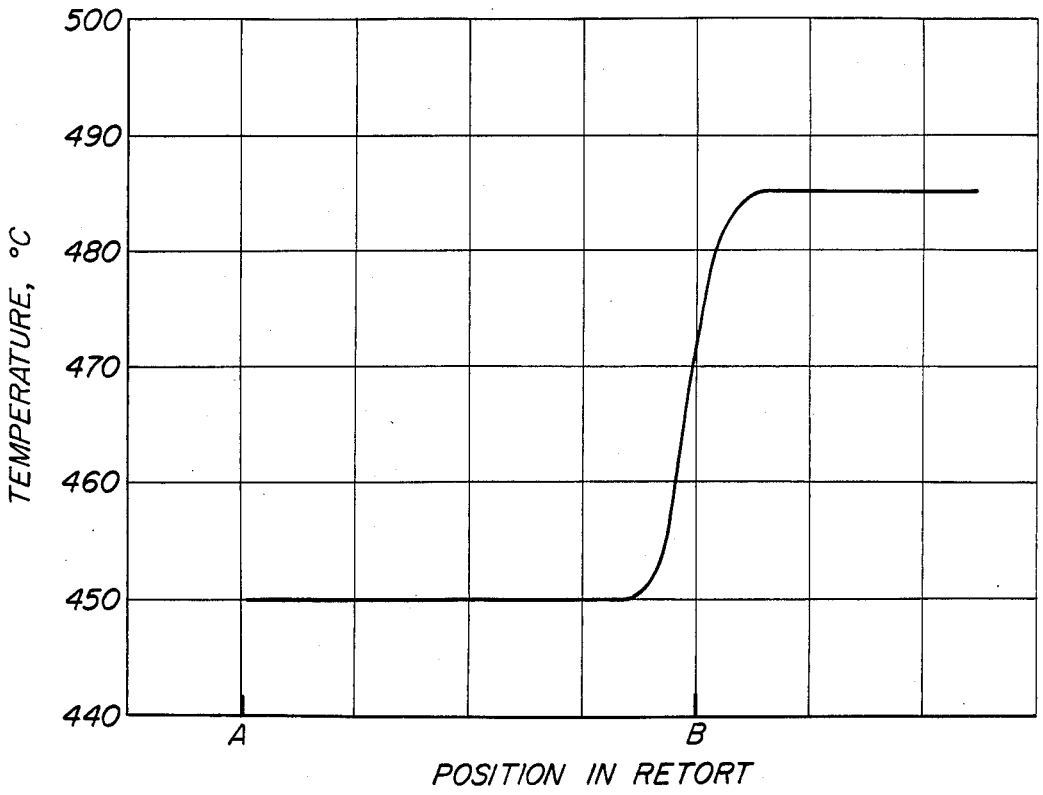
FIG. 2 is a graph showing a typical temperature profile for a retorting vessel of the general type illustrated in FIG. 1.

Referring to FIG. 1, fresh particulate oil shale enters the retorting vessel 2 by way of feed conduit 4. The oil shale forms a bed of material in the lower portion of the retorting vessel 6 and passes downward through a series of dispersing elements 8*a*, 8*b*, 8*c* and 8*d* which prevent slugging of the solids and limit gross vertical backmixing. Hot solid heat carrier particles enter the retorting vessel via conduits 10 and 12, the flow being controlled by valves 16 and 18, respectively. The preferred heat carrier particles are principally burned shale, i.e., retorted oil shale which has been burned to remove the carbonaceous residue. By controlling the rate at which the hot solid heat carrier particles enter the retorting vessel, a vertical temperature gradient is established with the lowest temperature being near the top of the bed of mixed material and the highest temperature being located near the bottom. This is illustrated in FIG. 2 wherein the reference positions in the retorting vessel are designated A and B which correspond to the levels at which conduits 10 and 12, respectively, enter the vessel.

Referring back to FIG. 1, a stripping gas is introduced into the retorting vessel via conduit 22 and passes upward in generally countercurrent flow to the downward moving shale. Product vapors and entrained fine material having a terminal velocity equal to or below the velocity of the exiting gas are carried upward and exit the retorting vessel via off gas conduit 24. The upper portion 26 of the retorting vessel is enlarged and serves as a solids disengaging area to prevent particles larger than a preselected size from being carried away with the off gas. The product vapors and stripping gas are separated from the fines in a cyclone 28.

Again referring to the retorting vessel 2, retorted oil shale mixed with hot solid heat carrier particles leaves the bottom of the vessel by means of conduit 30 and is carried to the combustor 32 where the carbonaceous residue on the retorted oil shale is burned. Typically, as shown, the combustor is a lift pipe with the retorted oil shale entering near the bottom. An air flow is introduced into the combustor via conduit 34 and entrains the shale particles carrying them upward. The residual carbonaceous material is combusted during the passage of the shale from the bottom to the top of the combustor. The burned shale leaves the combustor via solids conduit 36 and is passed to holding bin 38 where it is temporarily stored prior to recycling into the retorting vessel. Excess shale leaves the system via oulet 40. Flue gases from the combustor leave via flue gas outlet 42.

In carrying out the process that is the subject of this invention, it is essential that the retorting vessel be of a design that prevents substantial gross backmixing of solids within the bed of downward moving shale particles and that the design assures localized rapid mixing of the hot solid heat carrier particles with the oil shale after introduction. Retorting vessels, having internal dispersing elements are described in U.S. Pat. Nos. 4,199,432 and 4,183,800, meet these criteria. In a retorting vessel such as described above, approximately 90% of the volatile hydrocarbons will be retorted away in the cooler portion of the bed, i.e., that portion at or below about 480° C. The remaining volatiles will be recovered in the lower hotter zone of the bed. Using this process, thermal cracking of the evolved vapors would be minimized in the solids disengaging zone of the retort and in the bed itself. Higher oil product yields would be obtained instead of undesired coke or gas.

In process schemes using burned oil shale as a hot solid heat carrier, it is usually necessary to provide some means for separating the finer grained material from the recycle material. Generally, burned shale particles smaller than about 75 to 100 microns are unsatisfactory for use as heat carrier material. This separation may be accomplished in a cyclone, a sifting means, or in the solids disengaging area of the combustor lift pipe.

We claim:

1. A process for retorting oil shale wherein particulate raw oil shale is retorted by passing said raw oil shale into the upper portion of a vertically-elongated retorting vessel having a retorting zone equipped with a plurality of dispersing elements so constructed and arranged as to substantially limit backmixing and slugging of solids passing downward therethrough, heating the raw oil shale to retorting temperature principally by means of hot solid heat carrier particles to drive off volatile hydrocarbons, passing a non-oxidizing stripping gas upward through the retorting vessel, removing the volatile hydrocarbons and stripping gas from the upper portion of the retorting vessel, and withdrawing the resulting retorted oil shale from the lower portion of the retort, the improvement comprising establishing a temperature profile in the retorting zone by introducing the hot solid heat carrier particles into the retorting zone at two or more different levels along the vertical length of the retorting zone, whereby a temperature gradient is created along the vertical axis of the retorting zone with the lowest temperature being near the top of the zone.

2. The process of claim 1 wherein the temperature gradient varies along its length from a minimum of about 450° C. to a maximum not exceeding 510° C.

3. The process of claim 1 wherein burned oil shale is used as heat carrier particles.

4. A process for retorting a particulate carbon-containing solid wherein said carbon-containing solid is passed into the upper portion of a vertically-elongated retorting vessel having a retorting zone equipped with a plurality of dispersing elements so constructed and arranged as to substantially limit backmixing and slugging of solids passing downward therethrough, heating the carbon-containing solids to retorting temperature principally by means of hot solid heat carrier particles to drive off volatile hydrocarbons, passing a non-oxidizing stripping gas upward through the retorting vessel, removing volatile hydrocarbons and stripping gas from the upper portion of the retorting vessel, and withdrawing the resulting retorted solids from the lower portion of the retort, the improvement comprising establishing a temperature profile in the retorting zone by introducing the hot solid heat carrier particles into the retorting zone at two or more different levels along the vertical length of the retorting zone, whereby a temperature gradient is created along the vertical axis of the retorting zone with the lowest temperature being near the top of the zone.

* * * * *